US005950466A

United States Patent [19]

Moen

[11] Patent Number: 5,950,466

[45] Date of Patent: Sep. 14, 1999

[54] KEYWAY PLUG

[76] Inventor: Richard C. Moen, 18 Madison Dr., E. Sandwich, Mass. 02537

[21] Appl. No.: 08/989,721

[22] Filed: Dec. 12, 1997

[51] Int. Cl.[6] ..... E05B 17/14

[52] U.S. Cl. ..... 70/428; 70/395; 70/398

[58] Field of Search ..... 70/395, 428, 398, 70/423–427, 429–430

[56] References Cited

U.S. PATENT DOCUMENTS

| | | | |
|---|---|---|---|
| 1,696,326 | 12/1928 | Roethlisberger . | |
| 1,728,310 | 9/1929 | Sundel . | |
| 2,068,936 | 1/1937 | Unterberg . | |
| 2,591,652 | 4/1952 | Ziegliss | 70/424 |
| 2,662,390 | 12/1953 | Michnoff et al. . | |
| 3,276,233 | 10/1966 | Russell et al. . | |
| 3,408,842 | 11/1968 | Barnes et al. . | |
| 4,120,184 | 10/1978 | Gerlach | 70/395 |

FOREIGN PATENT DOCUMENTS

| | | | |
|---|---|---|---|
| 289878 | 9/1966 | Australia | 70/395 |
| 0015799 | 2/1977 | Japan | 70/395 |

*Primary Examiner*—Darnell M. Boucher
*Attorney, Agent, or Firm*—Morse & Altman

[57] ABSTRACT

A keyway plug that provides a means for preventing the correct key from opening a tumbler lock, including a plug and an extractor. The plug fits into the keyway to block complete insertion of a key. In one embodiment, an arm extends from the tip of the plug across the tumblers, but is short enough so that the outermost tumbler drops to hide the plug. In the second plug embodiment, the outermost tumbler drops into a notch to prevent the plug from going too far into the keyway. The extractor includes a narrow finger, the upper edge of which includes a hook that mates with a matching hook in the lower edge of the plug arm. As the extractor is removed, the hooks interlock, causing the plug to be removed.

3 Claims, 4 Drawing Sheets

KEYWAY PLUG

BACKGROUND OF THE INVENTION

1. Field of the Invention

The present invention relates to tumbler locks, more particularly, to a device for preventing a key from being inserted into a tumbler lock.

2. The Prior Art

Tumbler locks have a variety of uses, the most prevalent being as building door locks and as automotive ignition and door locks. There are occasions when it is desired to prevent a tumbler lock from being opened, even by the correct key. For example, a worker is given a key to a room that is only to be used during normal business hours. Or a person is loaned a car, but is told not to open the trunk. Or a person renting a locker is behind in his/her rental payments. In all cases, the key will be able to open the lock at any time, but for some reason, the person in possession of the key is to be prevented from doing so. A number of devices have been developed over the years to prevent the correct key from opening a lock, for example, U.S. Pat. No. 1,696,326 issued to Roethlisberger, U.S. Pat. No. 1,728,310 issued to Sundel, U.S. Pat. No. 2,068,936 issued to Unterberg, and U.S. Pat. No. 3,408,842 issued to Barnes et al. The common element of these disclosures is a plug that is inserted into the keyway that prevents any key from being completely inserted.

The plug of Roethlisberger fits into the keyway so that the outer tumblers return to rest on the lower arm of the plug, in front of the upper extension, blocking the plug from being removed. The major shortcoming of this design is that the plug must be long enough so that all of the tumblers drop onto the lower arm. If the arm is too short, the outermost tumblers will drop below the arm, to their normal locked position. If this should happen, the plug cannot be removed, even by the mating extractor, because the extractor cannot be inserted past the outermost tumbler. Another related shortcoming is that the inner end of the keyway must be at least partially closed so that the plug cannot be pushed too far and preventing the outermost tumbler from dropping as describe above.

The plug of Sundel solves the problems of Roethlisberger with an external plate that prevents the plug from being inserted too far into the keyway. However, unlike Roethlisberger, when the plug of Sundel is installed, it is very visible because to the external nature of the plate. Also, the external plate gives a person attempting to remove the plug a point of leverage, which may result in destruction of the lock.

The plug of Unterberg also attempts to solve the problem of being pushed to far into the keyway by using a notch in the upper surface of the plug that the innermost tumbler can fall into. However, because the notch must pass all of the other tumblers, it must be sloped on both sides. So it is still possible for the plug to be pushed too far into the keyway. Unterberg also uses a small external hook that prevents the plug from being inserted too far. However, the hook, like the external plate of Sundel, makes the plug more visible and gives a person leverage in an attempt to remove the plug, which would be relatively easy to do, since there is nothing holding the plug firmly in the keyway.

Unterberg and the plug of Barnes also have the problem that they, like Roethlisberger, must be long enough to extend over all of the tumblers. If the outermost tumbler should drop in front of the plug, the plug could not be removed. The flat end of the upper arm of the plug would be caught against the tumbler and the flat end of the extractor could not be inserted past the tumbler.

SUMMARY OF THE INVENTION

An object of the present invention is to provide a keyway plug for preventing the correct key from opening a tumbler lock.

Another object is to provide a keyway plug that is hidden within the keyway from casual inspection.

Yet another object is to provide a keyway plug that can be used easily in a keyway that is not closed at the inner end.

The keyway plug of the present invention provides a means for preventing the correct key from opening a tumbler lock, while overcoming the deficiencies of the prior art. A tumbler lock includes a cylindrical barrel that rotates within a shell, a keyway, and a series of tumblers. The correct key causes the tumblers to align, permitting the barrel to rotate.

The keyway plug of the present invention includes a plug and an extractor. The plug fits into the keyway to block entrance of a key. Its tip is similar to the tip of an ordinary key. An arm extends from the tip along the keyway. Unlike the plugs of the prior art, the arm of the first embodiment of the plug does not have to extend across all of the tumblers. It is preferred that the arm be short enough that the outermost tumbler drops behind the plug, hiding it from casual inspection. To overcome the problem of the prior art plugs where the outermost tumbler prevents the plug from being removed with the extractor, the end of the arm has an upper chamfer to push the outermost tumbler out of the way upon extraction.

A second plug embodiment is for use in a lock where the plug could be pushed out the other end. Unlike the first embodiment, the arm extends to the outermost tumbler, which drops into a notch in the upper edge of the arm. The outer edge of the notch is vertical to prevent the tumbler from sliding out of the notch, thus keeping the plug from moving farther into the keyway.

An extractor is used to remove the plug from the keyway. The extractor includes a narrow finger, the upper edge of which includes a hook that mates with a matching hook in the lower edge of the plug arm. As the extractor is being inserted into the keyway, the leading surface of the hook forces the plug upwardly against the tumblers. The plug will move upwardly because of the play between the keyway and plug. When the extractor and plug hooks become aligned, the tumblers push the plug back down against the extractor, and when the extractor is pulled from the keyway, the hooks mate to pull the plug from the keyway.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The keyway plug of the present invention provides a means for preventing the correct key from opening a tumbler lock. There are several different types of tumbler locks, including pin tumblers, disc tumblers, and sidebar tumblers. The figures of the present disclosure show the present invention in operation with a pin tumbler lock. However, these figures are intended to be illustrative only, and it is contemplated that the present invention will be used with any type of tumbler lock available.

Figure 1:
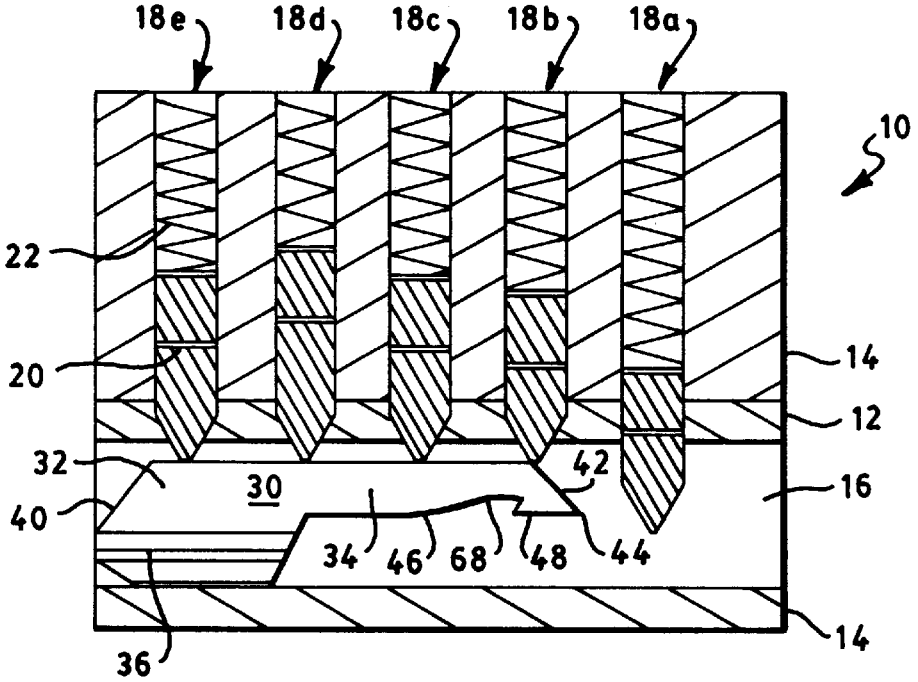
FIG. 1 shows a cross-sectional side view of the pin tumbler lock with an embodiment of the plug of the present invention installed.

FIG. 1 illustrates a typical tumbler lock 10, here a pin tumbler lock, with which the present invention will be used. The lock 10 includes a cylindrical barrel 12 that rotates within a shell 14, a keyway 16, and a series of pin tumblers 18*a*–18*e*. When the correct key (not shown) is inserted into the keyway 16, the pin tumblers 18*a*–18*e* are arranged so that the shear line 20 of all the tumblers 18*a*–18*e* are aligned, permitting the barrel 12 to rotate. Disc tumblers and sidebar tumblers operating in a slightly different manner, but all rely on the correct key aligning the tumblers to permit the barrel to rotate. When no key is inserted, a spring 22 biases the tumbler 18 into the keyway 16.

Figure 2:
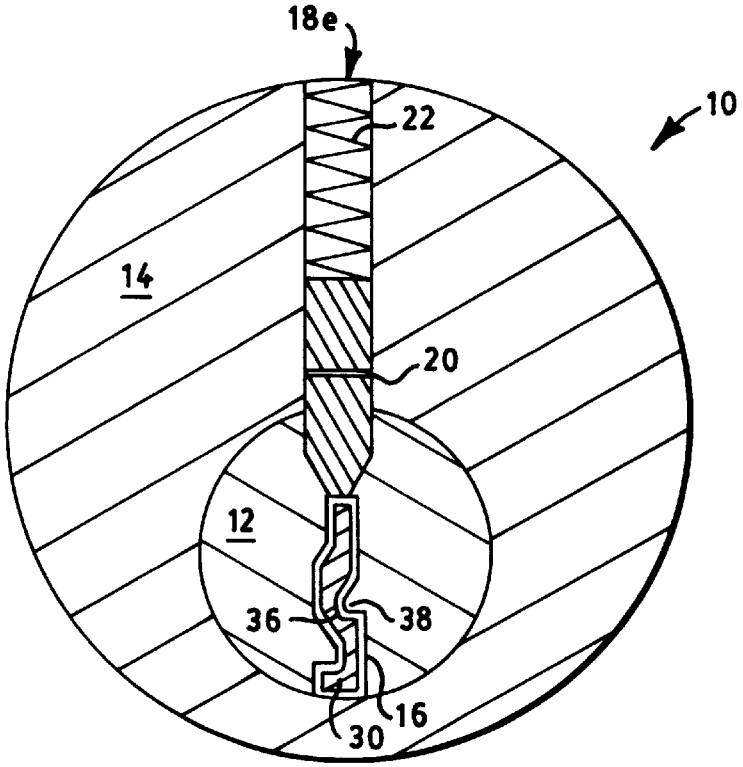
FIG. 2 shows a cross-sectional end view of the plug and keyway of FIG. 1.

The keyway plug of the present invention has at least two components, a plug 30 and an extractor 70. The purpose of the plug 30 is to prevent the key from being completely inserted into the keyway, keeping the tumblers misaligned. As seen in FIG. 1, the plug 30 comprises a tip 32 and an arm 34. The end profile of the lock 10 and plug 30, shown in FIG. 2, shows that the plug 30 has grooves 36 to match ridges 38 in the profile of the keyway 16. The tip 32 has the same height as an ordinary key so that it can be inserted into the keyway 16 without having to jiggle it up and down to find the grooves 36. The tip 32 is similar to the tip of an ordinary key. It includes an upper chamfer 40 that pushes the tumblers 18 up and out of the way when the plug 30 is inserted into the keyway 16.

The plug arm 34 extends away from the top of the tip 32 along the direction of the keyway 16. Unlike the plugs of the prior art, the arm 34 does not have to extend over all of the tumblers 18*a*–18*e*. In the embodiment of FIG. 1, it is preferred that the arm 34 be short enough that the outermost tumbler 18*a* drops its full extension into the keyway 16 behind the plug 30, hiding it from casual inspection. To overcome the problem of the prior art plugs where the outermost tumbler prevents the plug from being removed with the extractor, the end of the arm 34 has an upper chamfer 42, similar to the chamfer 40 at the tip 32.

Figure 3:
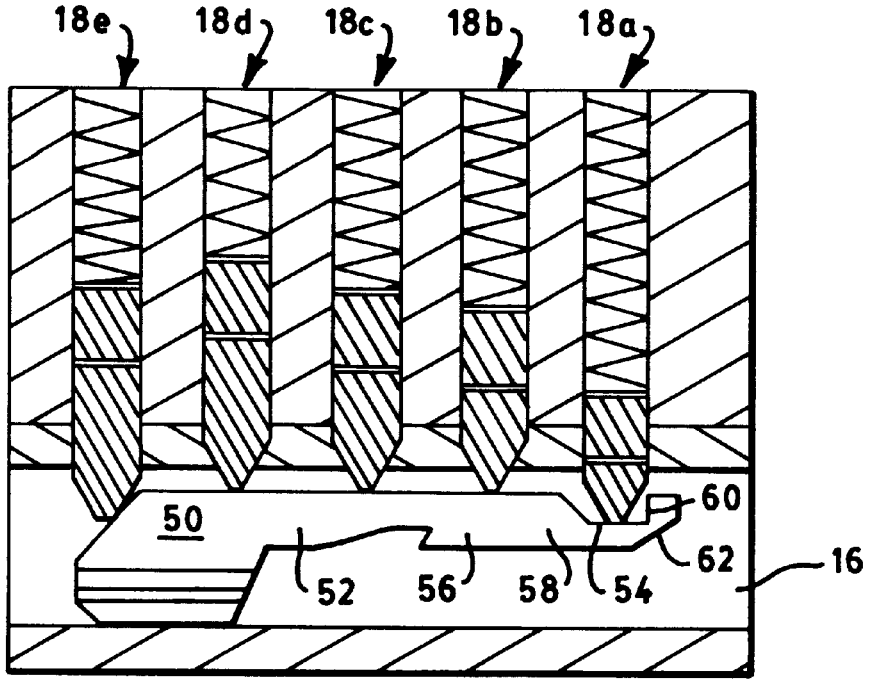
FIG. 3 shows a cross-sectional side view of the pin tumbler lock with a second embodiment of the plug of the present invention installed.

A second embodiment of the plug 50 is for use in a lock where the keyway 16 is not closed at its inner end is shown in FIG. 3. Unlike the embodiment of FIG. 1, the arm 52 extends to the outermost tumbler 18*a*. The arm 52, however, does not have to extend across all of the inner most tumblers 18*b*–18*e*. As the plug 50 is inserted into the keyway 16, the outermost tumbler 18*a* drops into a notch 54 in the arm's upper surface 56. The inner edge 58 of the notch 54 is sloped to allow the tumbler 18*a* to slide into and out of the notch 54. The outer edge 60, unlike the notch of Unterberg, is vertical enough to prevent the tumbler 18*a* from sliding out of the notch 54, thus keeping the plug 50 from being pushed too far into the keyway 16. In addition, the lower outer corner of the arm 58 has a chamfer 62 to make it more difficult to pry the plug 50 from the keyway 16.

The remainder of this detailed description refers specifically to the first plug embodiment 30 of FIG. 1. Unless specified otherwise, it is intended that the remainder of this detailed description also apply to the second plug embodiment 50 of FIG. 3.

Figure 4:
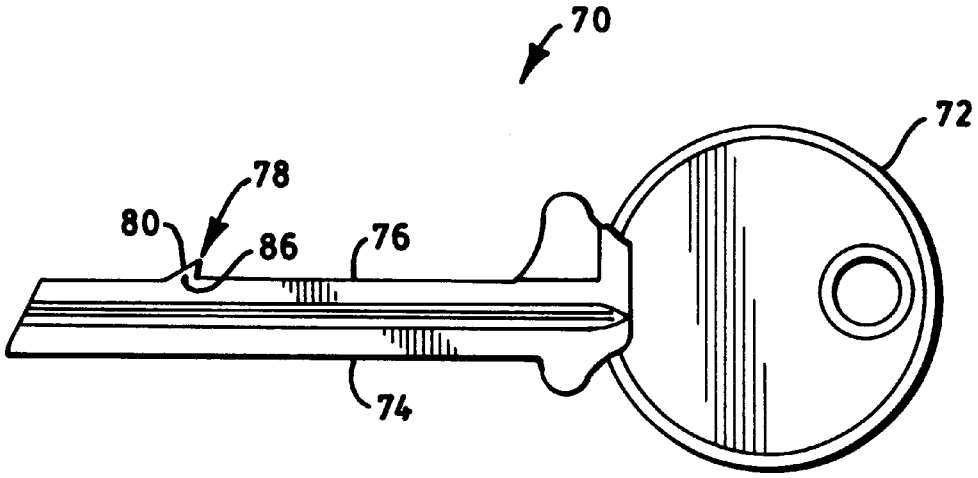
FIG. 4 shows a side view of an extractor.

The plug 30 is removed from the keyway 16 by an extractor 70, shown in FIG. 4. The extractor 70 includes a head 72 for grasping, like that of a regular key. A finger 74 extends from the head 72. The height of the finger 74 is such that its height, combined with the height of the plug arm 34, is slightly less than that of the keyway 16 so that the finger 74 and arm 34 can fit into the keyway 16 simultaneously. The upper edge 76 of the finger 74 includes a hook 78 that mates with a matching hook 48 in the lower edge 46 of the plug arm 34, as in FIG. 1. The leading edge 80 of the hook 78 is chamfered to facilitate insertion of the extractor 70 into the keyway 16.

Figure 5:
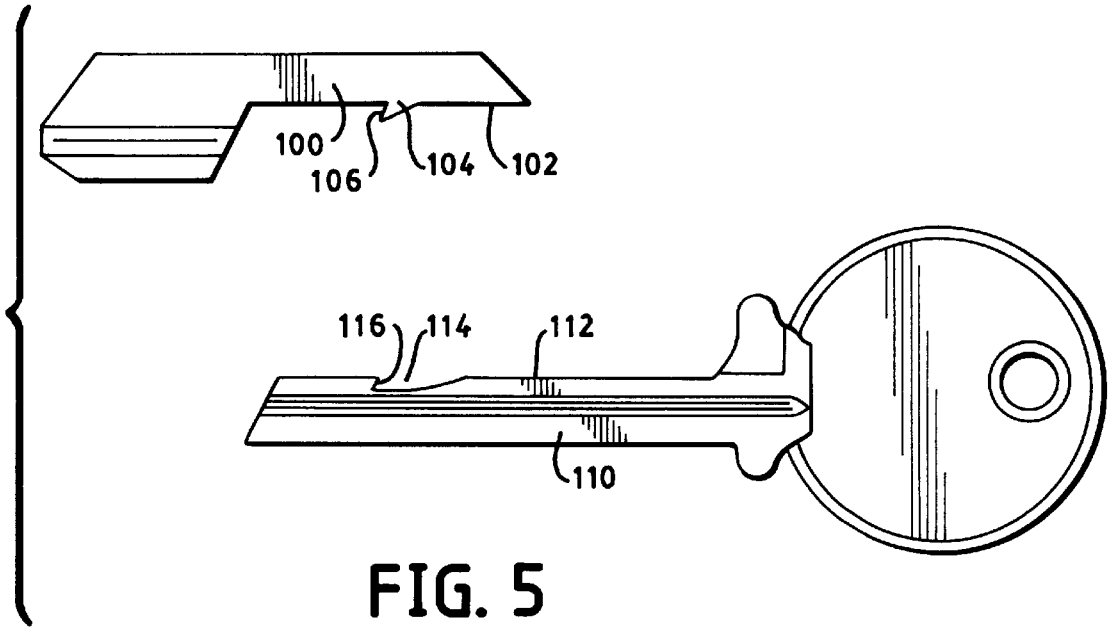
FIG. 5 shows a side view of an alternate embodiment of the plug and extractor.

FIGS. 1 and 4 show an arrangement where the plug hook 48 is formed by a shaped notch 68 in the lower edge of the arm and the extractor hook 78 is formed by a shaped protrusion 86. Alternatively, FIG. 5 shows an arrangement in which the plug hook 106 is formed by a shaped protrusion 104 from the lower edge 102 of the arm 100, and the extractor hook 116 is formed by a shaped notch 114 in the upper edge 112 of the extractor finger 110.

Figure 6:
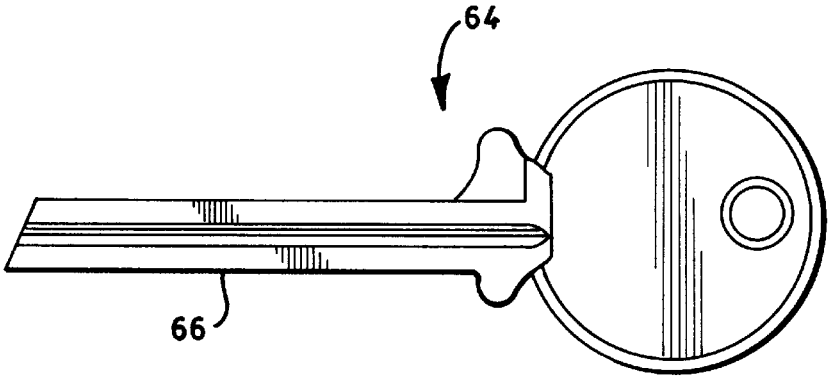
FIG. 6 shows a side view of an inserter.

The plug 30 is inserted into the keyway 16 by placing it in the entrance to the keyway 16 and pushing it into the keyway 16 until it stops, either by reaching the end of the keyway 16, as in FIG. 1, or by the outermost tumbler 18*a* dropping into the notch 54, as in FIG. 3. The plug 30 is initially placed and started into the keyway 16 manually. Once the plug 30 is inserted a small distance, to the point where a person's finger cannot push it in farther, a tool, such as the regular key or a key blank, must be used to push it in the rest of the way. Optionally, an inserter, shown in FIG. 6, is provided with the plug 30 and extractor 70. Preferably, the inserter 64 is similar to the extractor 70 with the exception that the inserter 64 lacks the hook 78 of the extractor 70. Also, the inserter finger 66 may be longer than the extractor finger 74, because it needs to be long enough to push the plug 30 all the way into the keyway 16. The inserter 64 is removed from the keyway 16 after the plug 30 is fully inserted. Because the inserter 64 does not have a hook, the plug 30 remains in the keyway 16.

Figure 7:
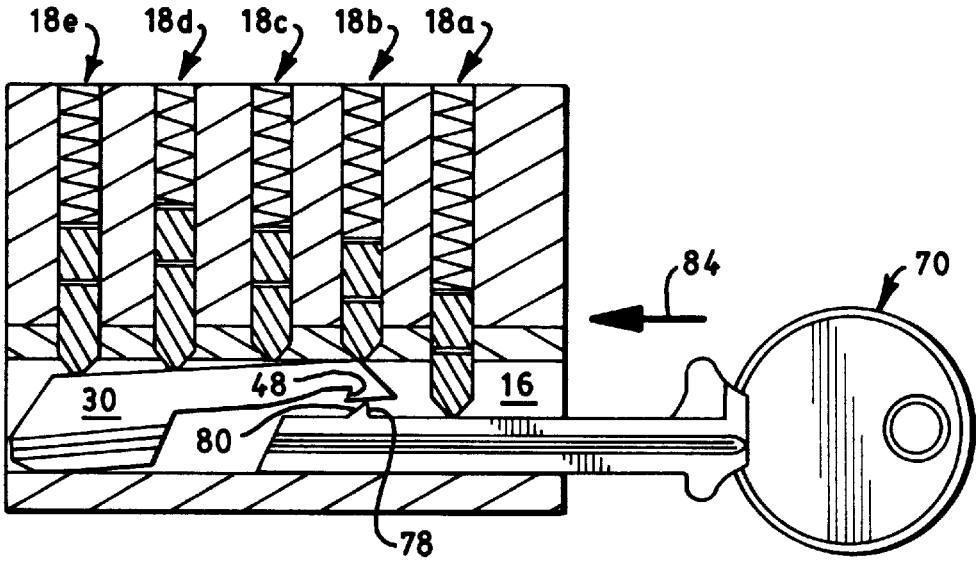
FIG. 7 shows a cross-sectional side view of the beginning of the extraction procedure.

The plug 30 is removed by inserting the extractor 70 into the keyway 16 and pushing it against the plug 30, as at 84. As the extractor 70 continues to be pushed farther into the keyway 16, the chamfered surface 80 of the extractor hook 78 forces the plug 30 upwardly against the tumblers 18*b*–18*e*, as in FIG. 7. The plug 30 will move upwardly because of the play between the keyway 16 and plug 30. As shown in the profile of FIG. 2, there are matching pair of grooves 36 and ridges 38 between the plug 30 and keyway 16. However, because these pairs are loosely fit, the plug 30 can move vertically a small amount relative to the keyway 16. Consequently, the height of the extractor hook 78 must not be larger than the greatest vertical displacement of the plug 30 in the keyway 16. If necessary, a loose fit is provided by extra-wide grooves 36 on the plug 30.

While the extractor 70 is being inserted, the spring-loaded tumblers 18*b*–18*e* are pushing downwardly against the plug

Figure 8:
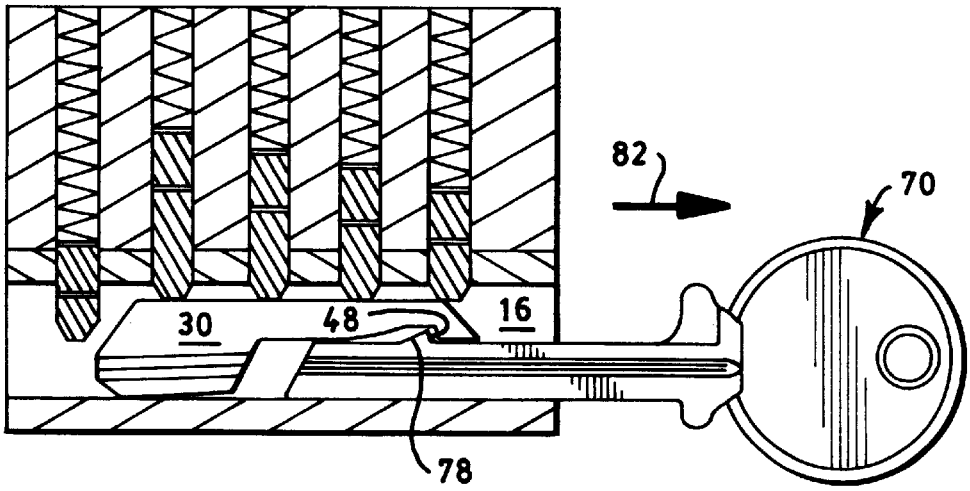
FIG. 8 shows a cross-sectional side view of the end of the extraction procedure.

30. When the hooks 48, 78 become aligned, the tumblers 18*b*–18*e* push the plug 30 back down against the extractor 70, and when the extractor 70 is pulled from the keyway 30, as at 82, the hooks 48, 78 mate, pulling the plug 30 from the keyway 16, as in FIG. 8.

Thus it has been shown and described a keyway plug which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A keyway plug for use with a tumbler lock having a keyway and a plurality of tumblers extending into said keyway, said plurality of tumblers including an outermost tumbler, said keyway plug comprising:

(a) a plug having a tip and an arm extending therefrom, said arm having a first edge in contact with said tumblers when installed in said keyway and having a second edge opposite said first edge, said second edge having a hook;

(b) said arm first edge including a notch having an inner edge and an outer edge, said inner edge permitting passage of said outermost tumbler into said notch as said plug is inserted into said keyway and permitting passage of said outermost tumbler out of said notch as said plug is removed from said keyway, said outer edge preventing passage of said outermost tumbler out of said notch when said plug is inserted completely into said keyway;

(c) an extractor including a grasping head and a finger, said finger having a first edge with a hook; and (d) said extractor hook adapted to mate with said plug hook to remove said plug from said keyway when said extractor finger is inserted into and then removed from said keyway.

2. The keyway plug of claim 1 wherein said arm hook is formed by a notch in said arm second edge and said extractor hook is formed by a protrusion on said finger first edge.

3. The keyway plug of claim 1 wherein said arm hook is formed by a protrusion on said arm second edge and said extractor hook is formed by a notch in said finger first edge.

* * * * *